United States Patent [19]

Greaney

[11] 3,944,225

[45] Mar. 16, 1976

[54] BASEBALL BAT BATTING PRACTICE SLEEVE

[76] Inventor: Daniel F. Greaney, 10 Chesbrough Road, West Roxbury, Mass. 02134

[22] Filed: Sept. 23, 1974

[21] Appl. No.: 502,456

[52] U.S. Cl. ..... 273/26 B; 273/194 B

[51] Int. Cl.[2] ..... A63B 69/40

[58] Field of Search .. 273/26 R, 26 B, 72 R, 194 R, 273/194 A, 194 B

[56] References Cited

UNITED STATES PATENTS 3,489,415 1/1970 Smith ..... 273/194 R

*Primary Examiner*—Richard C. Pinkham

*Assistant Examiner*—T. Brown

[57] ABSTRACT

A practice sleeve used in connection with baseball and similar bats which prevents a ball struck by the bat from going any significant distance and improves the users swing. The sleeve is fabricated from a single sheet of rectangular plastic material having a pair of concentric notches cut into one surface the entire length of the plastic sheet. These notches are spaced approximately ½ inch apart and are spaced an equal distance from the longitudinal center line of the sheet. The plastic is then folded about the notches to form a substantially V-shaped troughed sleeve having a ½ inch blunted ball hitting surface. The sleeve is then provided with shock cords, transversly attached thereto, for holding the sleeve on a bat.

3 Claims, 4 Drawing Figures

BASEBALL BAT BATTING PRACTICE SLEEVE

This invention relates to practice sleeves and more particularly to a practice sleeve described and defined in my application assigned U.S. Pat. No. 3,833,217 and having a filing date of Sept. 3, 1974.

In making use of the practice sleeve described in my previous invention it was found desirable to use shock cord almost exclusively for attaching the sleeve to the bat. It has also been found that 3 shock cords, one at each of the extreme ends sleeve and one at the middle of the sleeve. It was also discovered that a slot cut in the sleeve would permit one of the shock cords to be removed at one end rather easily. By installing the sleeve over the bat and looping that shock cord about the bat and then inserting it in the slotted end a very tight connection was made which prevented the sleeve from moving about the bat even after numerous hours of use and significant impact by rather powerful batters.

Younger batters especially those in such activities as the Little League benefit a great deal by the use of the practice sleeve. However, in order to encourage the young batter to improve his swing, it has been found desirable to have a ⅝ inch blunted edge along the "V" shaped tip as an optimum size. This makes the batter more enthusiastic because it encourages him to hit the ball in a straight level plane.

Therefore, the object of the present invention is to provide an improved practice sleeve having one shock cord permantly affixed at one end and long enough completely encircling the bat at least once and be reaffixed at the slotted end.

Another object of the present invention is to provide an improved practice sleeve which has a blunted tip of approximately ½ inch its entire length.

Another object of the present invention is to provide an improved practice sleeve having three shock cords holding it against the bat.

Other objects, features and advantages of the present invention will be better understood from the attached detailed specification, when read in conjunction with the attached drawings of which:

Figure 1:
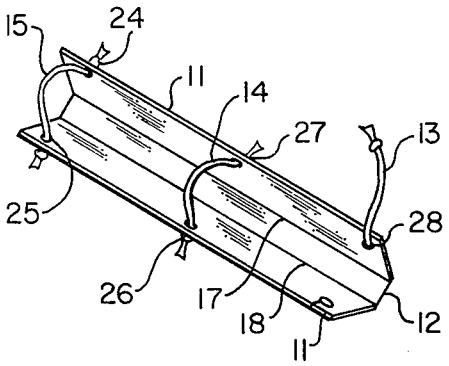
FIG. 1 is the improved practice sleeve.

Referring now the FIG. 1, we see the practice sleeve. The improved practice sleeve 11 has 3 shock cords 15, 17, and 13 to connect it or attach it to a bat. We also note a surface in the inside 12. We also note notches 17 and 18 in the plastic material. We take note of a slotted opening for connecting one end of shock cord 13.

Figure 2:
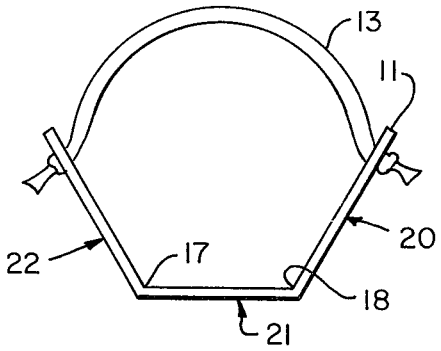
FIG. 2 is an end view of the practice sleeve.
Figure 3:
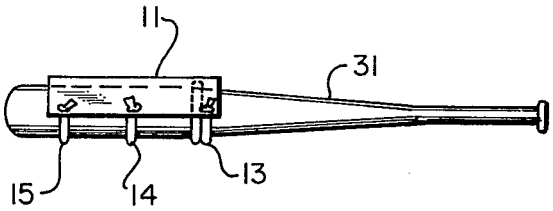
FIG. 3 shows the practice sleeve installed on a bat.

Referring to FIG. 2 we see the end view of the practice sleeve. Here we note as a result of slots 17 and 18, we have two sloping surfaces 22 and 20, and which presents a blunted "V" shaped tip 21. The optimum size of the blunted edge is ⅝ of an inch.

In practice the sleeve is fabricated from a single sheet of plastic cut out as a rectangular strip. Holes 25, 24, 26, 27, 28 and 16 are drilled into the plastic along the outside edge to receive the shock cords. Notches 17 and 18 are cut into the plastic and extend the length of the plastic sheet. These slots that are cut into the plastic are approximately ⅝ inch apart and are centered in the plastic strip running the entire length of it. The plastic can be folded along the slots to form the sloping surfaces 20 and 22. The depth of slots 17 and 18 is approximately 25% of the sheet thickness making it easy to bend. As a result of the bend about these slots, a ½ inch surface is presented for the batter to hit the ball. By having a larger surface younger baseball players, particularly those in Little League will be able to practice and improve their swing without getting unduly discouraged. The larger surface enables the young batter to hit the ball more often. By his hitting the ball more often he becomes more enthusiastic with his success and therefore practices more diligently. It is contemplated that a number of practice sleeves can be produced that have varying size tips gradually getting smaller and smaller as the batter improves. In the first instance with younger batters it is recommended and has been found optimum to provide a surface of approximately ⅝ inch in width that runs the entire length of the practice sleeve.

Hole 16 in sloping surface 22 is not connected to the shock cord 13 in FIG. 1. When the sleeve 11 is slid over the bat such that shock cords 15 and 14 slide onto the top end of the bat, and then by means of a slot 40 (to be described later) the cord is then slipped into hole 16 holding the practice sleeve tightly against the bat and firmly in place.

As the swinger swings the bat and strikes the sleeve against various balls the centrifugal force on the sleeve cannot cause the sleeve to be removed from the bat. The shock cord being wrapped about the bat provides additional contact with the bat and holds the sleeve in place even while the sleeve is undergoing considerable forces. By wrapping the shock cord around the bat at least once it is assured that the sleeve will not separate from the bat regardless of usage.

Figure 4:
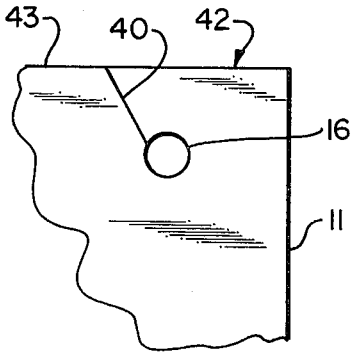
FIG. 4 shows the slotted corner of the sleeve.

Referring now to FIG. 4 we see a sectional view of the sleeve where slot 40 and hole 16 are noted. When the sleeve is placed around the bat and shock cord 13 is wrapped at least once around the bat the corner 42 is bent away from the surface 43 such that the cord can slip down the slot 40, into hole 16. It is to be noted that the slot 40 is at an angle away from corner 42. The reason for having the slope away from that direction is to enable the cord to remain in place because the centrifugal force on this sleeve is in the opposite direction to the slope.

Although I have described my invention with reference to specific apparatus, it is to be clearly understood that those skilled in the art may make many substitutions and variations without departing from its true scope and spirit, accordingly, I only wish to be limited by the appended claims.

I claim:

1. An improved practice sleeve in combination with a conventional baseball bat comprising, a strip of yieldable plastic having two concentric slots running the entire length of the strip, said slots having a preselected debth and separated approximate ½ inch apart (a preselected distance centrally located) whereby the strip can be bent about the slots forming a three sided substantially V-shaped trough, the area between said slots defined by said ½ inch separation being a blunted tip of said sleeve; and a plurality of shock cords, each of said cords being transversely attached across the trough opening of said sleeve at a point therealong for removably securing said sleeve to said bat, a portion of the large end of said bat being enclosed between the walls and shock cords; one of said shock cords having one of its ends permanently affixed to said sleeve and its other end being extended around said bat before being removably attached to said sleeve at a point remote from said one affixed end.

2. A practice sleeve according to claim 1 wherein said shock cords number at least three.

3. A practice sleeve according to claim 2 wherein said other end of said cord is knotted and said sleeve is provided with a hole in one of its sloping sides; a through slot extending from said hole to the edge of said sloping side being provided for receiving said cord for movement from said edge to said hole, said knot being larger than the diameter of said hole to facilitate anchoring said one end of said shock cord to said sloping side.

* * * * *